US011192710B2

(12) United States Patent
Lee

(10) Patent No.: US 11,192,710 B2
(45) Date of Patent: Dec. 7, 2021

(54) HAIR PRODUCT PACKAGING AND METHOD OF MANUFACTURING THE SAME

(71) Applicant: Beauty Plus Trading Co., Inc., Moonachie, NJ (US)

(72) Inventor: Chang Moo Lee, Moonachie, NJ (US)

(73) Assignee: Beauty Plus Trading Co., Inc., Moonachie, NJ (US)

( * ) Notice: Subject to any disclaimer, the term of this patent is extended or adjusted under 35 U.S.C. 154(b) by 0 days.

(21) Appl. No.: 17/315,278

(22) Filed: May 8, 2021

(65) Prior Publication Data

US 2021/0261323 A1 Aug. 26, 2021

Related U.S. Application Data

(60) Provisional application No. 63/131,414, filed on Dec. 29, 2020.

(51) Int. Cl.
*B65D 85/00* (2006.01)
*A41G 5/00* (2006.01)
*B65D 73/00* (2006.01)

(52) U.S. Cl.
CPC ..... *B65D 85/70* (2013.01); *A41G 5/0046* (2013.01); *B65D 73/0028* (2013.01)

(58) Field of Classification Search
CPC ..... A41G 5/00; A41G 5/004; A41G 5/0046; A41G 3/00; A41G 3/0075; B65B 5/04; B65D 73/00; B65D 73/0028; B65D 85/70
USPC ..... 206/337, 388
See application file for complete search history.

(56) References Cited

U.S. PATENT DOCUMENTS

| | | | | |
|---|---|---|---|---|
| 3,702,508 | A * | 11/1972 | Netter | A45D 44/005 206/388 |
| 9,259,044 | B2 * | 2/2016 | Kim | B65D 75/321 |
| 10,160,584 | B2 * | 12/2018 | Yi | B65D 77/26 |
| 10,624,402 | B2 * | 4/2020 | Kim | A41G 5/0046 |
| 10,786,026 | B1 * | 9/2020 | Jhin | A41G 5/0046 |
| 10,945,478 | B1 * | 3/2021 | Jhin | B65B 15/00 |
| 2014/0083445 | A1 * | 3/2014 | Wright | A41G 5/0086 132/201 |
| 2021/0235801 | A1 * | 8/2021 | Smith | A41G 5/006 |

* cited by examiner

*Primary Examiner* — Bryon P Gehman
(74) *Attorney, Agent, or Firm* — John H. Choi & Associates

(57) ABSTRACT

A hair product packaging includes a hair product having a plurality of hair strands. Each hair strand has a first end and an opposing second end. The plurality of hair strands are separated into a plurality of bundles. Each bundle has a proximal end and an opposing distal end. The hair strands of each bundle are folded such that the first and second ends are substantially aligned with each other at the distal end while a substantial mid-point of the hair strands form a loop at the proximal end. The packaging also includes a plurality of retaining members with the loop of each bundle positioned within a retaining member. A securing member secures the plurality of retaining members together. The packaging also includes a backing member. The securing member is fixed to the backing member such that the hair product is positioned on the backing member and displayed.

20 Claims, 13 Drawing Sheets

HAIR PRODUCT PACKAGING AND METHOD OF MANUFACTURING THE SAME

CROSS-REFERENCE TO RELATED APPLICATION

This application claims priority to U.S. Provisional Application No. 63/131,414, filed on Dec. 29, 2020, titled "System and Method of Packaging Hair Product," which is incorporated by reference in its entirety.

BACKGROUND

Hair extensions are natural or synthetic hairs that are attached to existing scalp hair to give the appearance of hair having different characteristics such as length, thickness, volume, texture, color and style.

One popular method and style of installing hair extensions is a braiding method in which hair extensions are braided with natural hair of the user. These types of hair extensions are typically packaged and sold as thick bundles of free hair strands.

With this method or style, a stylist must first prepare the hair extensions by separating the thick bundles of hair extension strands into manageable portions. Each manageable portion is placed at or near the wearer so that the stylist has quick access to each separated portion for use while braiding the hair extensions with the wearer's natural hair. As such, much time is consumed to prepare the hair extensions before installation, and as result labor cost is increased. Therefore, the wearer must pay a premium to install the hair extensions.

Also, it is difficult for the stylist to separate the hair extensions into equal portions because it is impossible to count the number of hair strands within each portion in an efficient manner. Therefore, the stylist can separate portions of hair extensions only based on what she sees and feels and thus, each separated portion of hair extensions are not necessarily equal in volume.

From a manufacturer's point of view, it is quite difficult to package hair extensions in a secure and presentable manner. The strands of the hair extensions must be evenly aligned and must remain as such during transport and display. Thus, currently, manufacturers are only able to package the hair extensions in thick bundles to ensure that the hair extensions remain as packaged prior to a wearer purchasing the same. For example, each bundle is held together with a rubber band so that the hair extensions remain as packaged throughout transport and display.

It is very difficult to package hair extensions in smaller bundles because of packaging constraints. First, it would be very time consuming to secure each smaller bundle with a rubber band. Second, it is difficult to then package multiple smaller bundles of hair extensions together in one package. Third, this could increase costs in terms of labor as well as packaging because the overall size of packaging would increase due to the increase in overall volume.

Therefore, a need exists for cost efficient, pre-packaged hair extensions that are securely separated into equally manageable portions in one package.

SUMMARY

The following presents a simplified summary of some embodiments of the invention in order to provide a basic understanding of the invention. This summary is not an extensive overview of the invention. It is not intended to identify key/critical elements of the invention or to delineate the scope of the invention. Its sole purpose is to present some embodiments of the invention in a simplified form as a prelude to the more detailed description that is presented later.

In one aspect, the present invention provides a hair product packaging comprising: a hair product having a plurality of hair strands, each hair strand having a first end and an opposing second end, the plurality of hair strands separated into a plurality of bundles, each bundle having a proximal end and an opposing distal end, the hair strands of each bundle folded such that the first and second ends are substantially aligned with each other at the distal end while a substantial mid-point of the hair strands form a loop at the proximal end, the plurality of bundles forming a set; a plurality of retaining members, the loop of each bundle positioned within a retaining member; a securing member, the securing member configured to secure the plurality of retaining members together; and a backing member, the securing member being fixed to the backing member such that the hair product is positioned on the backing member and displayed.

In another aspect, the present invention provides a hair product packaging comprising: a hair product having a plurality of hair strands, each hair strand having a first end and an opposing second end, the plurality of hair strands separated into a plurality of bundles, each bundle having a proximal end and an opposing distal end, the hair strands of each bundle folded to form a loop between the first and second ends; a plurality of retaining members, the loop of each bundle positioned within a retaining member; a securing member, the securing member configured to secure the plurality of retaining members together; and a backing member, the securing member being fixed to the backing member such that the hair product is positioned on the backing member and displayed.

In yet another aspect, the present invention provides a method for packaging a hair product comprising a plurality of hair strands having a first end and an opposing second end, the method comprising the steps of: separating the plurality of hair strands into a plurality of bundles; folding the hair strands of each bundle to form a loop between the first and second ends; positioning each loop within a retaining member of a plurality of retaining members; securing the plurality of retaining members together with a securing member; and fixing the securing member to a backing member such that the hair product is positioned on the backing member and displayed.

The hair product packaging and method of the present invention solves the problems of the prior art and provides additional advantages. The present invention provides cost efficient, pre-packaged hair extensions that are securely separated into manageable portions in a single package. With the present invention, a stylist is capable of saving much time because the stylist need not pre-divide the hair extensions prior to installing them on a wearer.

BRIEF DESCRIPTION OF DRAWINGS

The foregoing summary, as well as the following detailed description of presently preferred embodiments of the invention, will be better understood when read in conjunction with the appended drawings. For the purpose of illustrating the invention, there are shown in the drawings embodiments which are presently preferred. It should be understood, however, that the invention is not limited to the precise arrangements and instrumentalities shown.

In the drawings.

Figure 1:
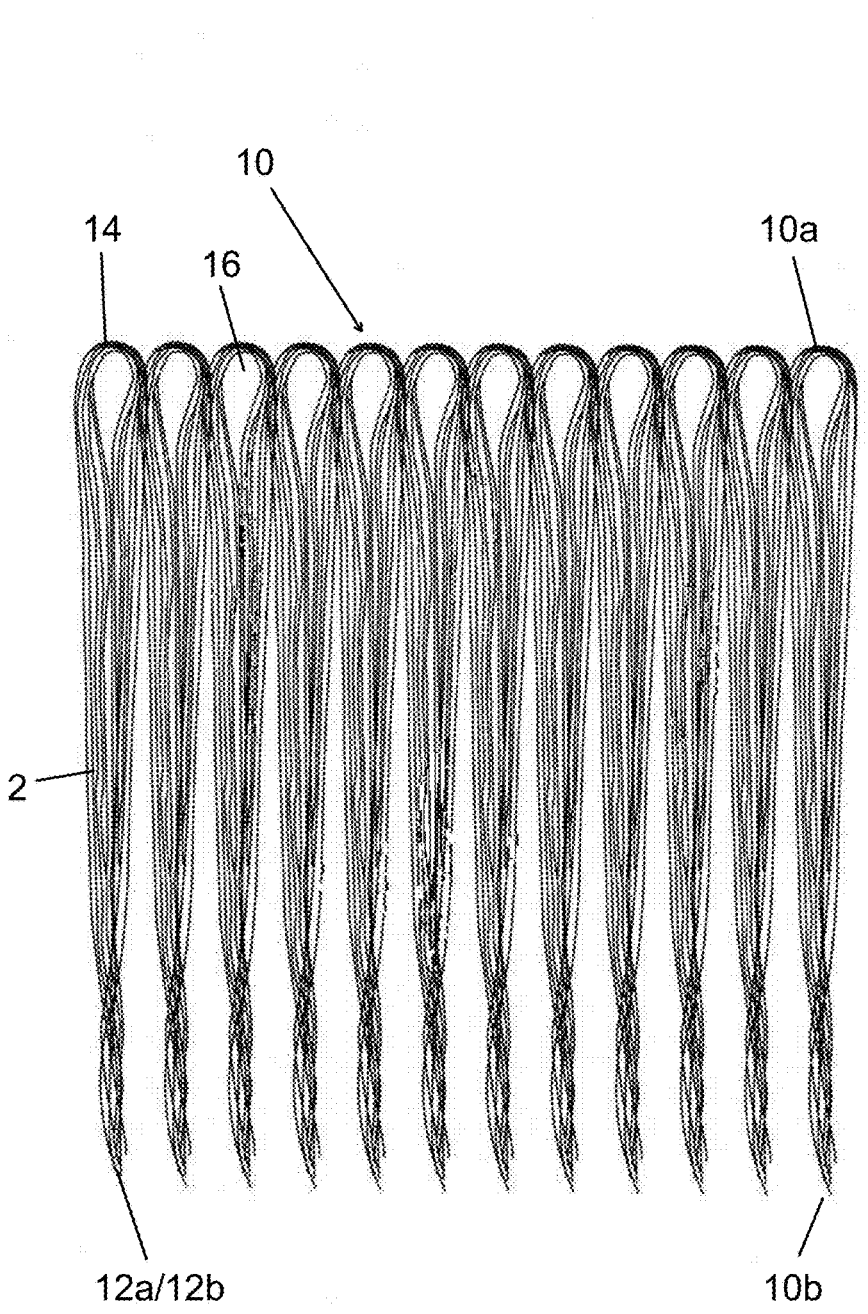
FIG. 1 shows prepared bundles of hair strands.

To facilitate an understanding of the invention, identical reference numerals have been used, when appropriate, to designate the same or similar elements that are common to the figures. Further, unless stated otherwise, the features shown in the figures are not drawn to scale and are shown for illustrative purposes only.

DETAILED DESCRIPTION

Certain terminology is used in the following description for convenience only and is not limiting. The article "a" is intended to include one or more items, and where only one item is intended the term "one" or similar language is used. Additionally, to assist in the description of the present invention, words such as top, bottom, side, upper, lower, front, rear, inner, outer, right and left are used to describe the accompanying figures. The terminology includes the words above specifically mentioned, derivatives thereof, and words of similar import.

Figure 18:
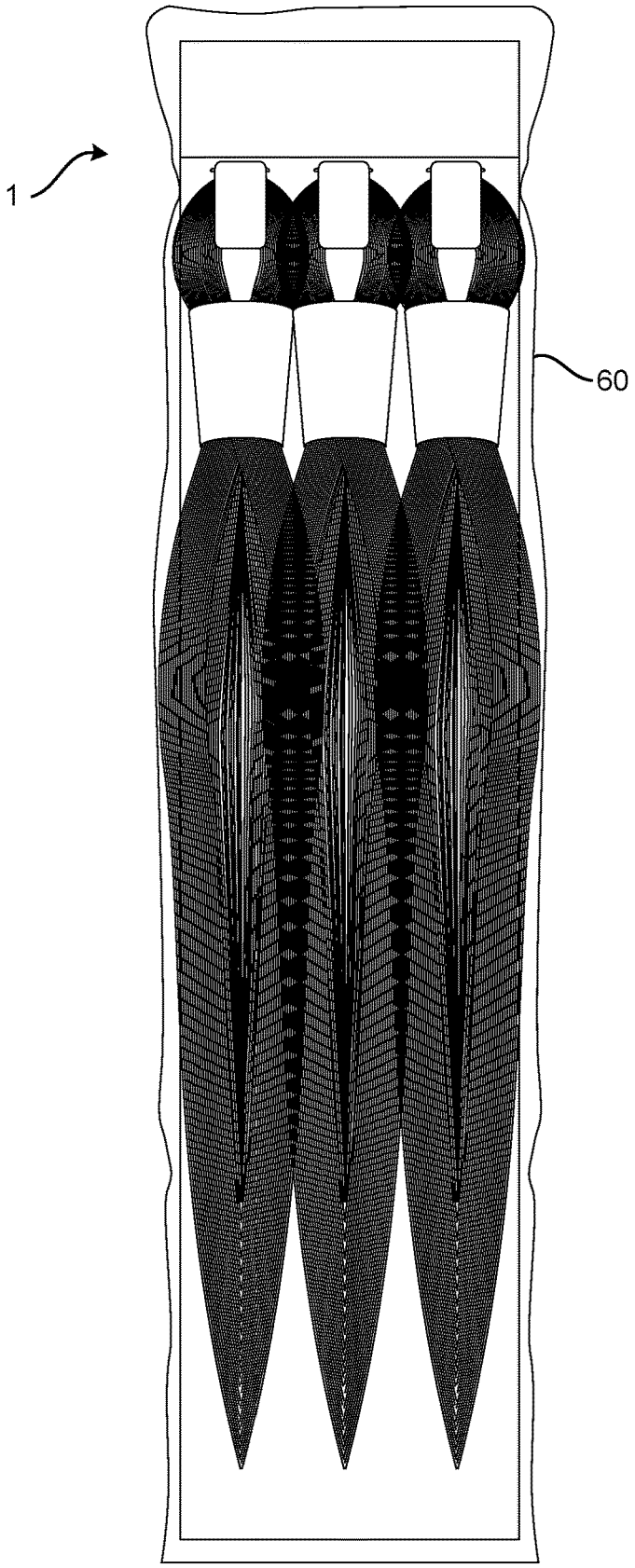
FIG. 18 shows the hair product packaging of the present invention in a fully assembled state.

A hair product packaging 1 of the present invention in a fully assembled state is shown in FIG. 18. The various components of the hair product packaging 1 are described in detail below.

Referring to FIG. 1, pre-stretched strands of hair 2, each having a first end 12*a* and an opposing second end 12*b*, are formed in bundles 10, preferably twelve bundles, as stylists prefer to work with this amount when applying hair extensions to a wearer's natural hair. Each bundle 10 includes a substantially equal number of strands 2 and have a proximal end 10*a* and distal end 10*b*. Each bundle 10 is configured so that ends 12*a*, 12*b* of the strands of hair 2 are substantially aligned at the distal end 10*b* while the bundle 10 is substantially folded at or about a mid-point 14 of the bundle 10 at the proximal end 10*a*, to form a loop 16. However, the hair strands 2 could be folded asymmetrically, i.e., without having the ends 12*a*, 12*b* aligned and without the loop 16 being at the mid-point 14 of the bundle 10.

Figure 2:
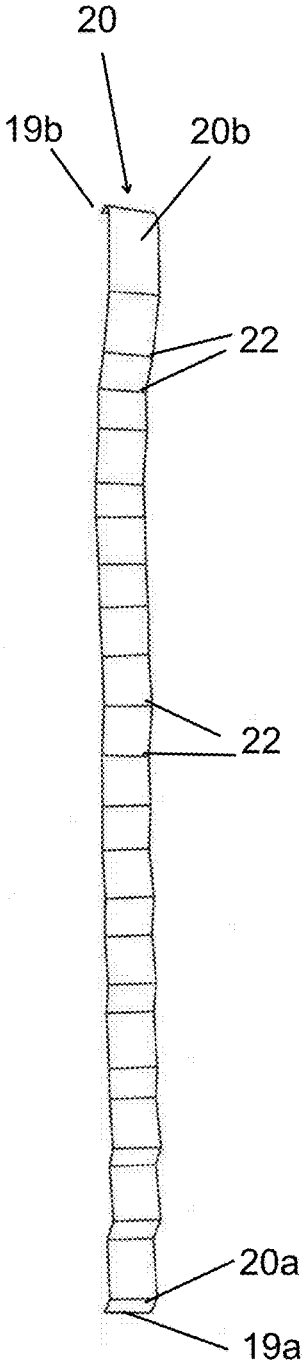
FIG. 2 shows a divider of the present invention prior to use.
Figure 3:
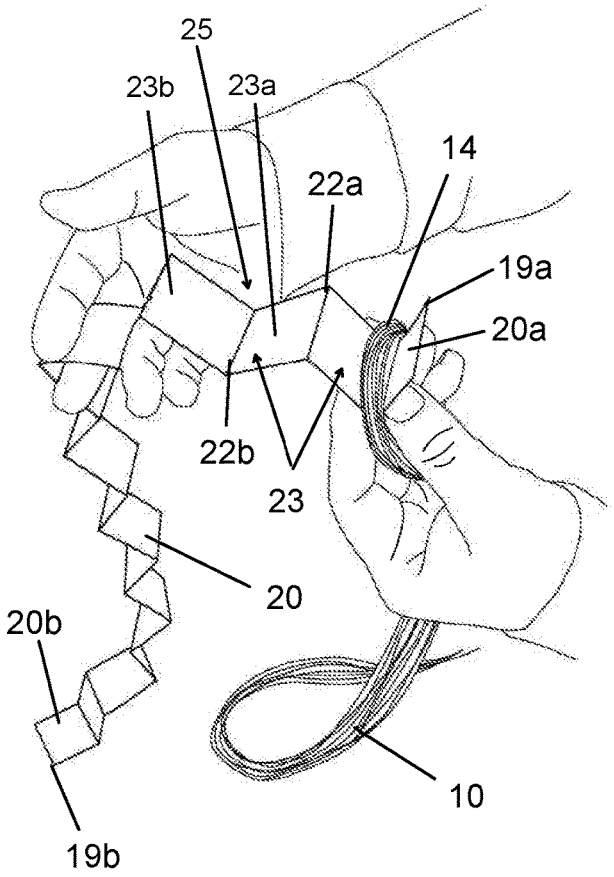
FIGS. 3-9 show the steps of installing the prepared bundles of hair strands on the divider.
Figure 4:
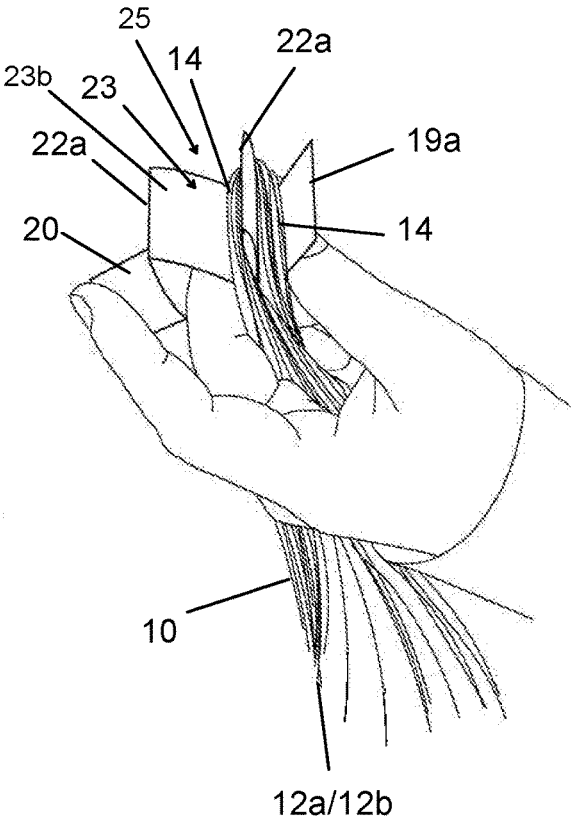
Figure 5:
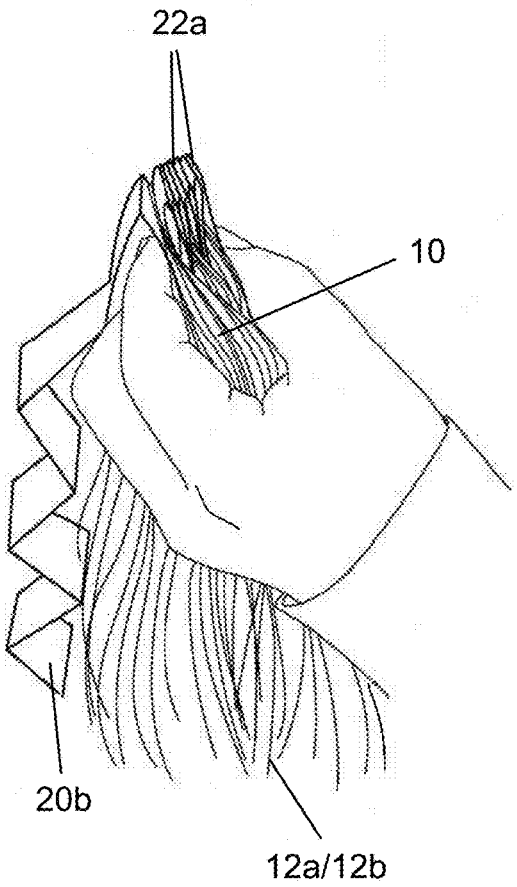
Figure 6:
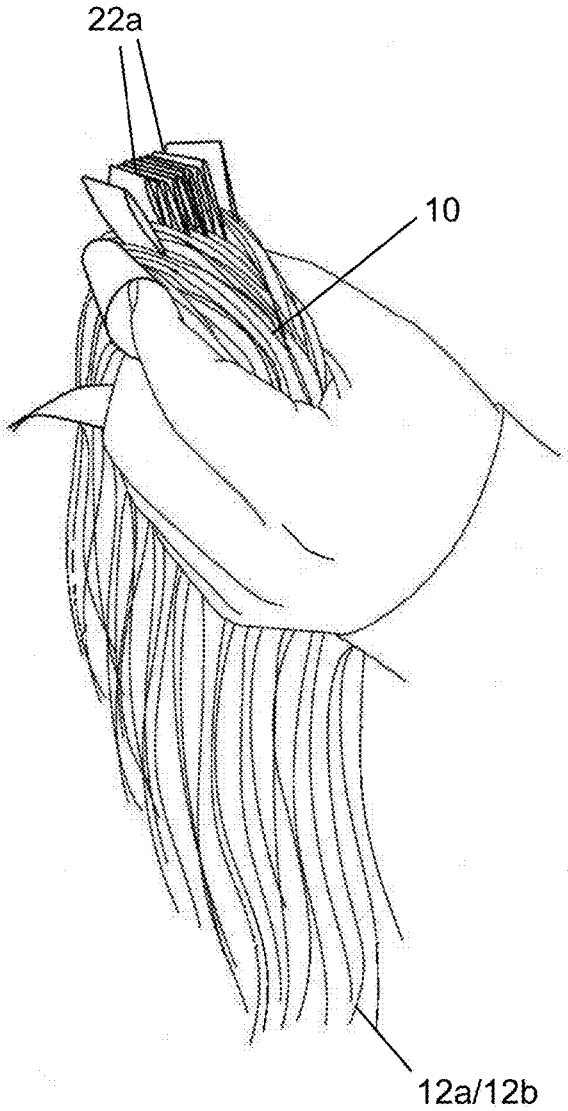

Referring to FIG. 2, a pre-folded divider 20 having a first end section 20*a* and a second end section 20*b* is provided. The first end section 20*a* culminates at a free first end 19*a* and the second end section 20*b* culminates at a free second end 19*b*. The divider 20 includes a plurality of fold lines 22, with each fold line 22 alternating in opposite directions forming an accordion fold. Specifically, the fold lines 22 include an upper fold line 22*a* followed by a lower fold line 22*b* in alternating fashion as shown, for example, in FIGS. 3 and 15.

Figure 7:
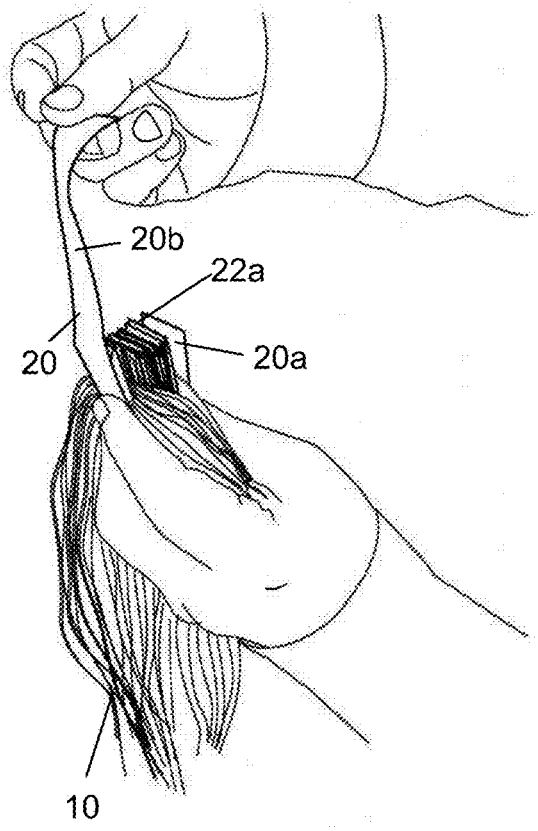
Figure 8:
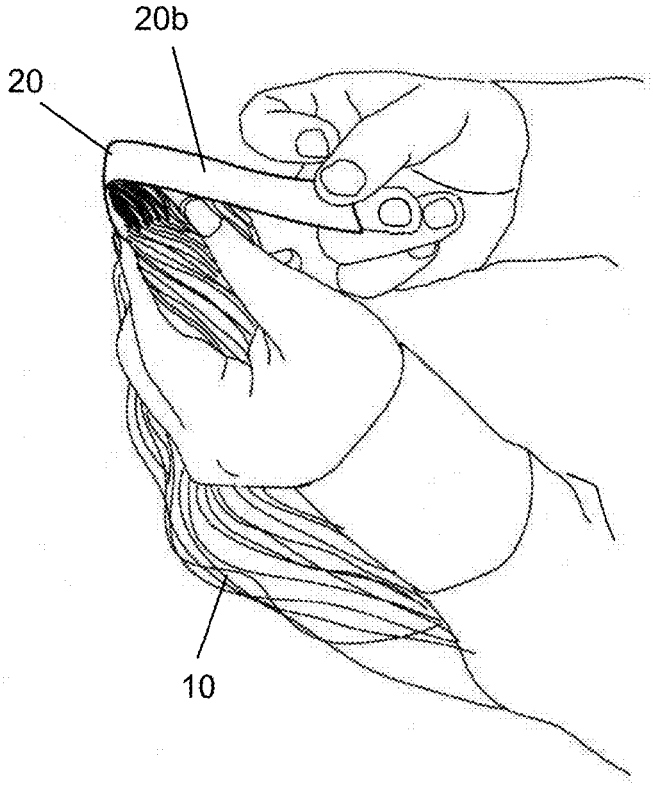
Figure 9:
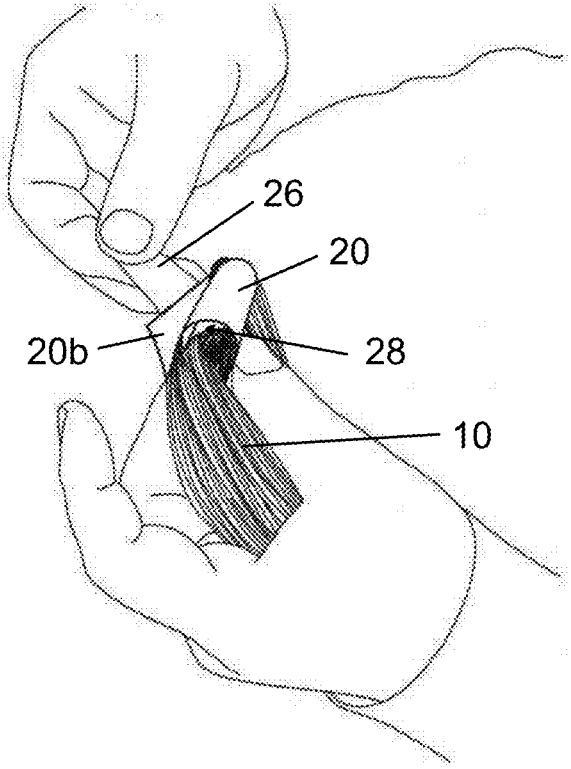

As shown in FIGS. 7 and 8, the second end section 20*b* of the divider 20 is extended without fold lines 22 and is further provided with an adhesive on at least one side of the second end section 20*b*, preferably a bottom side. In the alternative, an adhesive is not applied to the second end section 20*b* and instead, an adhesive tape 26, as shown in FIG. 9, is attached to the second end 19*b*. In a further alternative, the second end section 20*b* could include both an adhesive on a bottom side as well as an adhesive tape 26.

The divider 20 is constructed of a substantially rigid but thin paper material that will not easily tear and is sufficiently durable to withstand folding. The thin paper material is coated or laminated to provide additional durability. One of ordinary skill in the art will recognize that the divider 20 could be constructed of other materials. For example, the divider 20 could be constructed of a plastic with pre-formed fold lines and a flexible second end section 20*b*.

Referring to FIGS. 3-6, retaining members 23 are formed between opposing and adjacent upper fold lines 22*a*. Each bundle 10 is installed within each retaining member 23 by placing each loop 16 on or above a lower fold line or lower engagement portion 22*b*. That is, a pair of retaining walls 23*a*, 23*b* extend downwardly from respective free ends of upper fold lines 22*a* and are coupled together at the lower engagement portion 22*b*, and an open space 25 is formed above the lower engagement portion 22*b* between the retaining walls 23*a*, 23*b*. In this embodiment, each bundle 10 is installed on consecutive retaining members 23. However, each bundle 10 could be spaced apart and need not be installed on consecutive retaining members 23. For example, each bundle 10 could be installed on every other retaining member 23, depending on the desired purpose or look of the final packaging.

Referring to FIGS. 7-9, upon completion of installation of the bundles 10 within the retaining members 23, the bundles 10 are compressed toward each other while the second end section 20*b* of the divider 20 is tightly wrapped around the fold lines 22 to form a secure engagement therewithin. As such, the loops 16 remain within each respective retaining member 23 without being displaced. That is, with each bundle 10 tightly engaged within each respective retaining member 23, the mid-point 14 of each bundle 10 is consistently held above while the distal ends 12*a* of each bundle 10 are consistently aligned below to form a desirable look for packaging and display.

Figure 10:
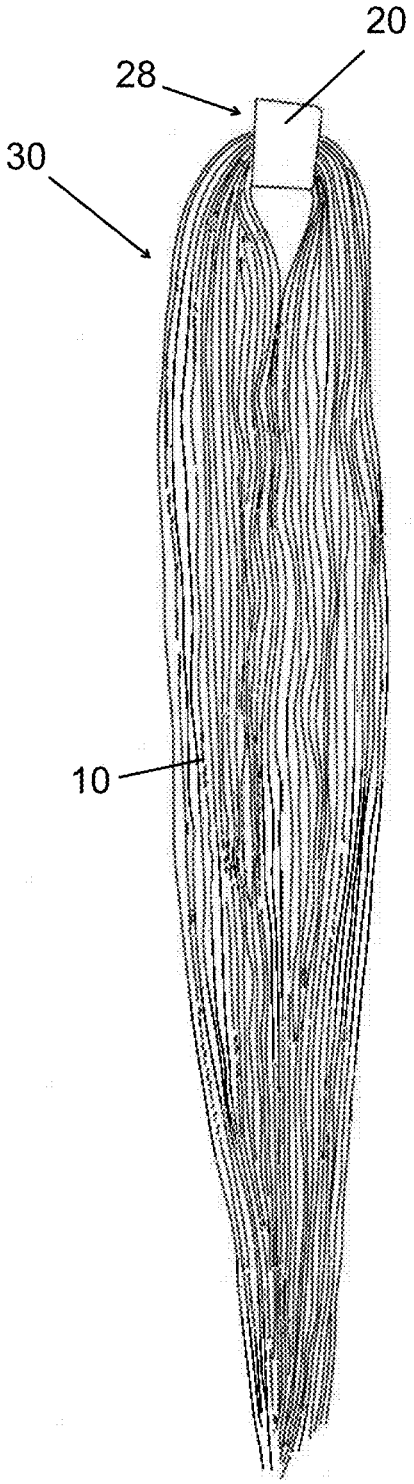
FIG. 10 shows the prepared bundles of hair strands fully installed on the divider.
Figure 12:
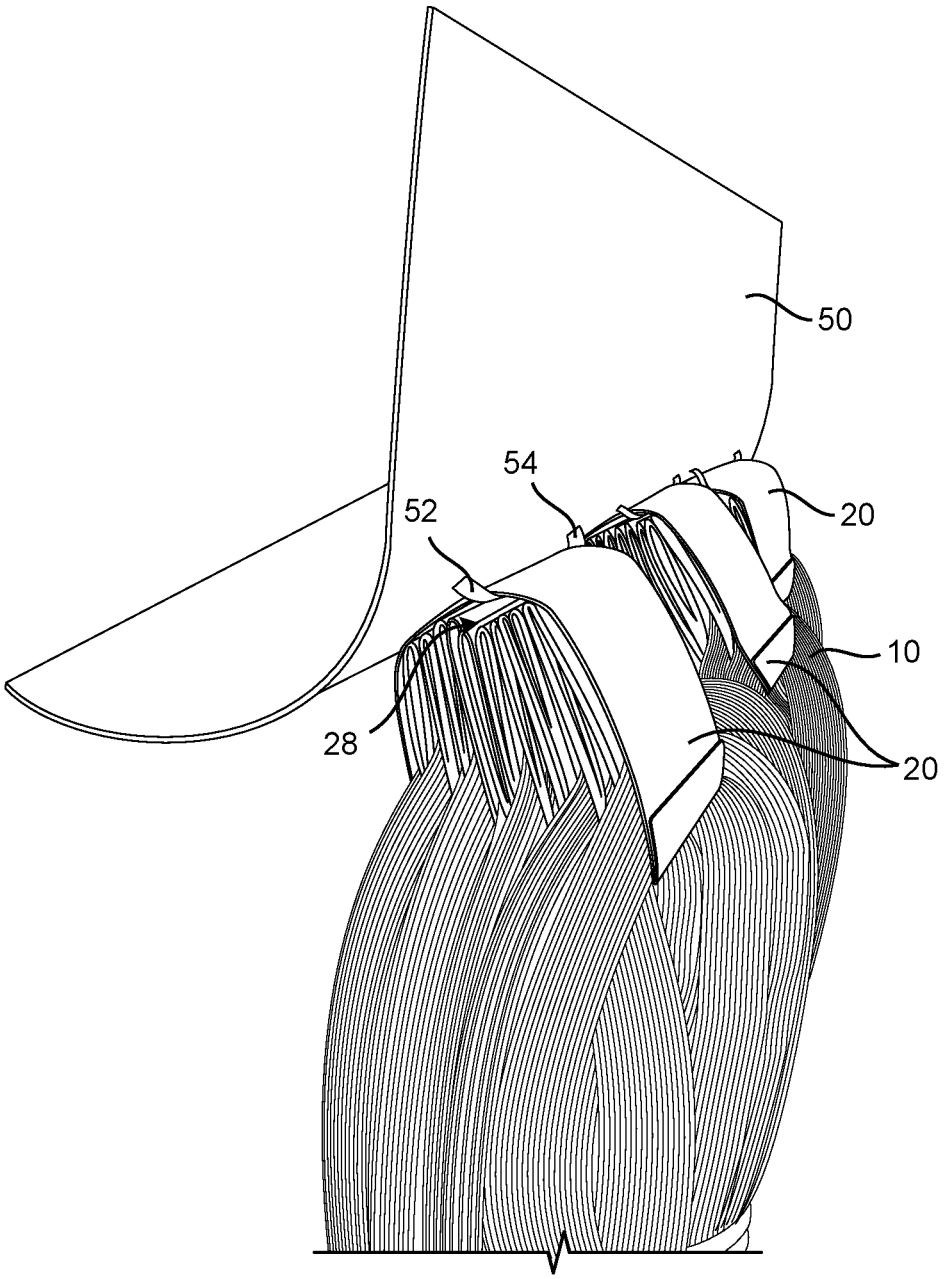
FIG. 12 shows a close-up view of the bundles of hair strands installed on the backing member.

Referring to FIGS. 9 and 10, as described above, the second end section 20*b* of the divider 20 may be provided with an adhesive so that the second end section 20*b* is secured to the remaining portions of the divider 20. In addition, further adhesive means 26, such as an adhesive tape, is secured to the second end 19*b* to further secure the second end section 20*b* to the remaining portions of the divider 20. As such, the second end section 20*b* and adhesive means 26 act as a securing member for securing the plurality of retaining members 23 together. As a result, a channel 28 is formed between the wrapped second end section 20*b* and the retaining members 23, providing an opening on each side of the divider 20, as shown in FIG. 12. As such, a completed set 30 of bundles 10 is formed.

Figure 11:
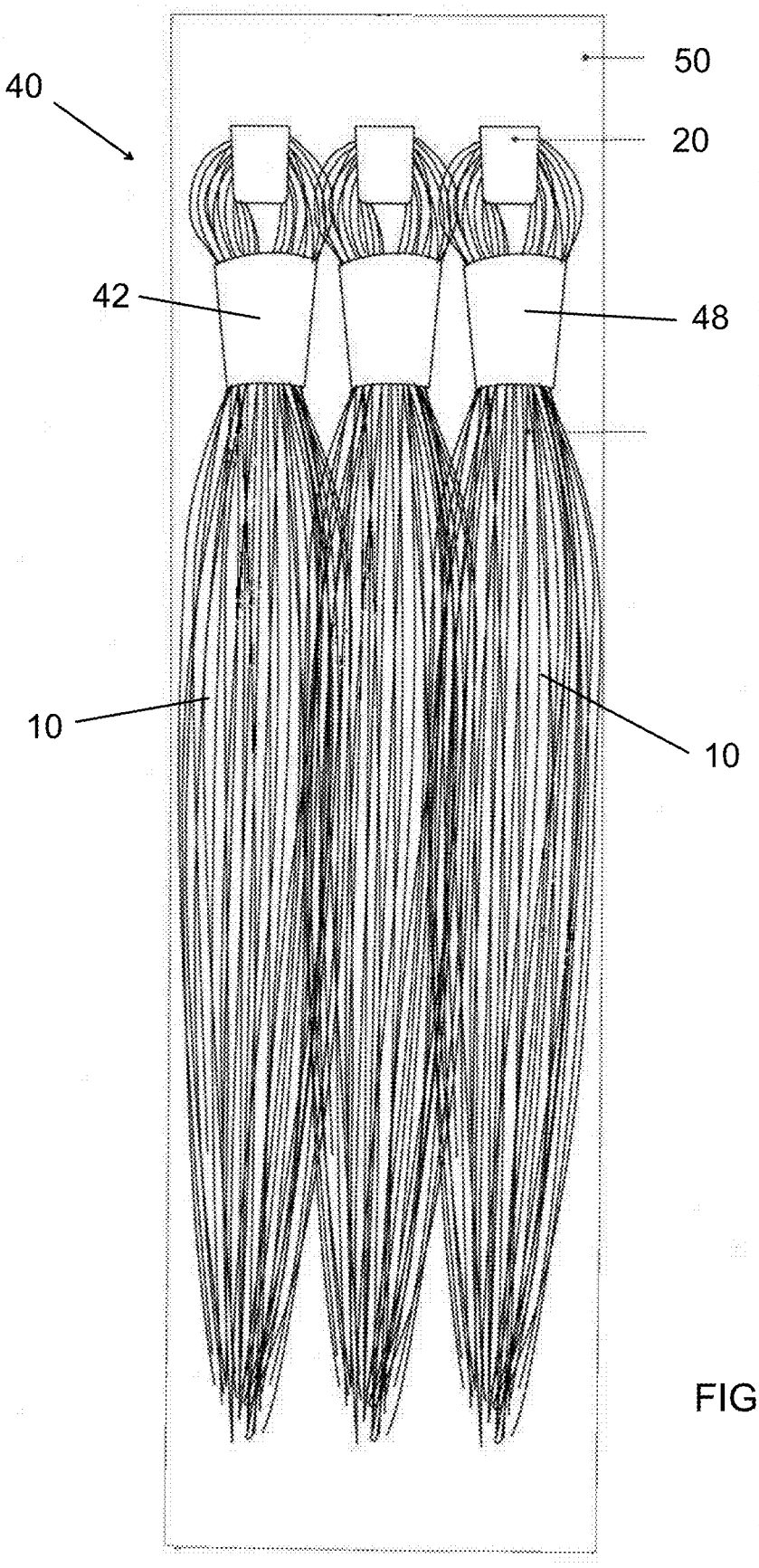
FIG. 11 shows the bundles of hair strands installed on a backing member.
Figure 16:
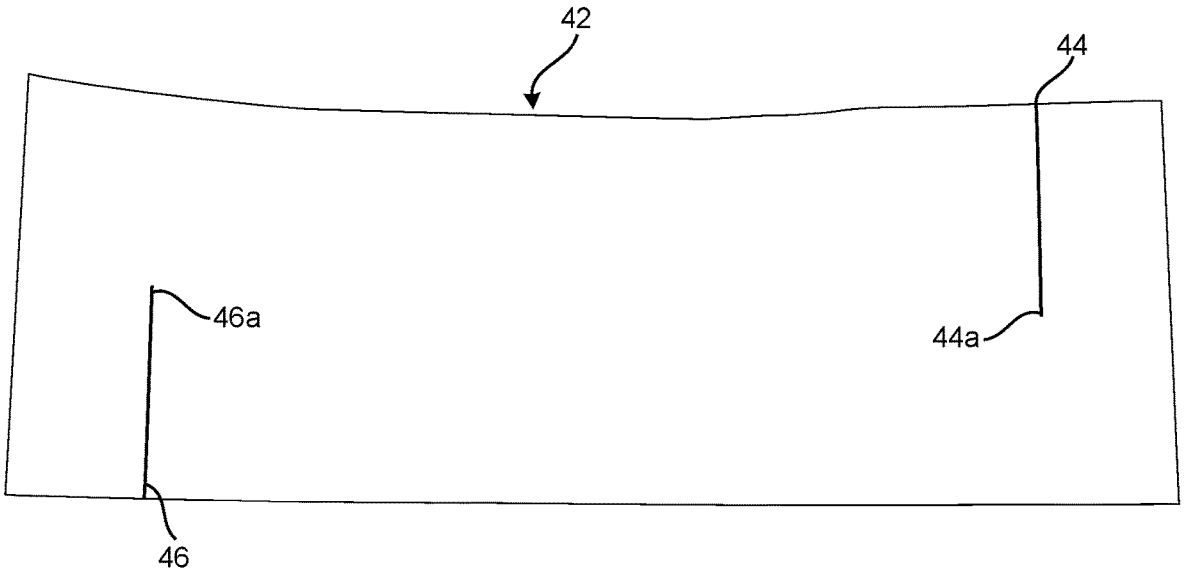
FIG. 16 shows a coupling member of the present invention in a disengaged state.
Figure 17:
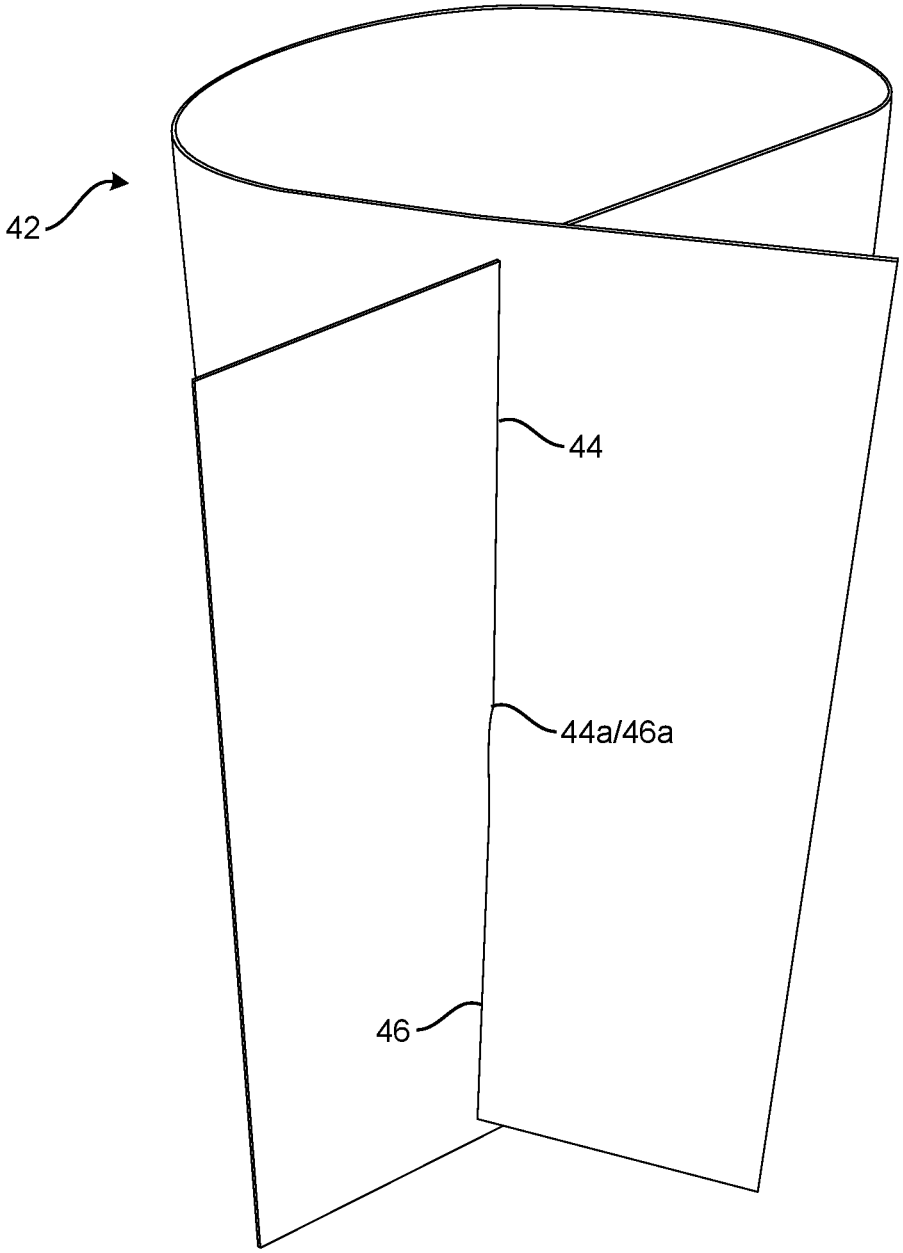
FIG. 17 shows the coupling member of FIG. 16 in an engaged state.

Referring to FIG. 11, each set 30 is then installed into a pre-final packaging 40. To further secure the bundles 10 of each set 30, a coupling member 42 is applied to each pre-divided set of bundles 30 below the divider 20. In this embodiment, as shown in FIGS. 16 and 17, the coupling member 42 is a thin, flexible material such as laminated paper that is wrapped around and secured to each pre-divided set 30. The coupling member 42 includes upper and lower slits 44, 46 on opposite sides and ends. Each slit 44, 46 extends about midway 44*a*, 46*a* the coupling member 42. When assembled, as shown in FIG. 17, the coupling member 42 circumscribes the set 30 and the opposing slits 44, 46 are engaged and locked into each other at the midway points 44*a*, 46*a* such that opposing edges of the coupling member 42 are substantially aligned. When packaged, the rear portion of the coupling member 42 (FIG. 17), is positioned away from view, as shown in FIGS. 11 and 18. Each coupling member 42 could include printed information for marketing purposes, particularly on a front portion 48.

Figure 13:
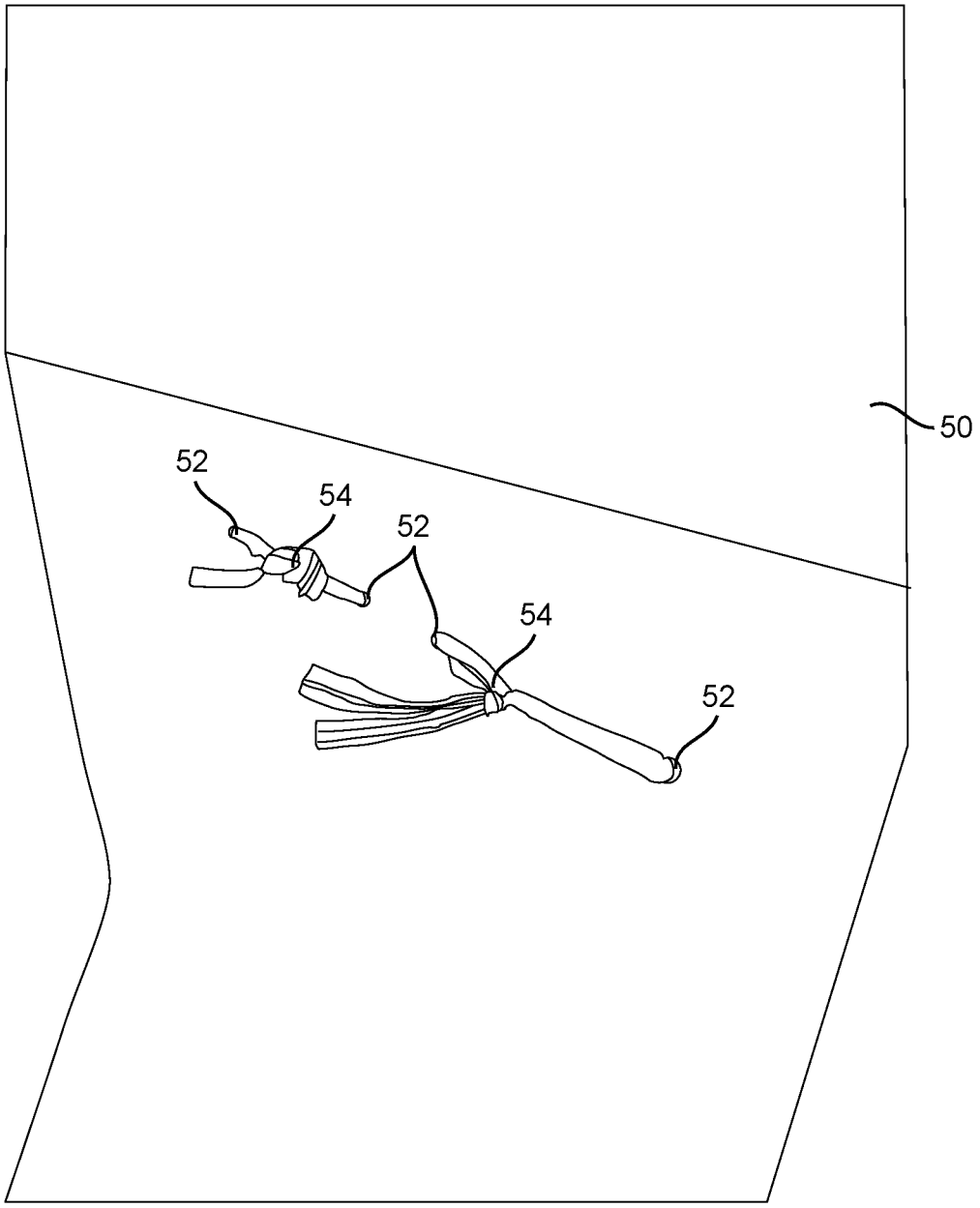
FIG. 13 shows a rear perspective view of the backing member of FIG. 12.

Referring to FIGS. 11 and 12, a backing member 50 is provided for further installing each pre-divided hair extension bundle set 30. In this embodiment, the backing member 50 is constructed of laminated paper but other materials could be used, for example, cardboard. The backing member 50 could include printed material for advertising purposes. The backing member 50 is provided with a plurality of apertures 52 spaced apart substantially equal to the width of each folded divider 20. Each pre-divided hair extension bundle set 30 is secured to the backing member 50 by extending a fastener 54 through the channel 28 of each pre-divided hair extension bundle set 30 and further extending the fastener 54 through corresponding apertures 52. In this embodiment, the fastener 54 is a twist tie. Ends of each twist tie 54 are then engaged and secured together on a rear section of the backing member 50, as shown in FIG. 13, to fix the pre-divided hair extension bundle sets 30 to the backing member 50. Other fasteners could be used as well, such as, rubber bands and clips. In the alternative, the folded divider 20 of the bundle set 30 could be attached to the backing member 50 with an adhesive. The backing member 50 could vary in size and shape and any number of bundle sets 30 could be attached to a backing member 50.

Referring to FIG. 18, a cover 60 is applied to the pre-final packaging 40 shown in FIG. 11 to fully enclose the components of the packaging 1, i.e., the bundle sets 30, retaining members 23, securing members 20*b*, 26 and backing member 50. The cover 60 is preferably constructed of a clear plastic material so that consumers could view the hair strands 2 inside of the packaging 1. The cover 60 could include printed material for marketing and advertising purposes.

Figure 14:
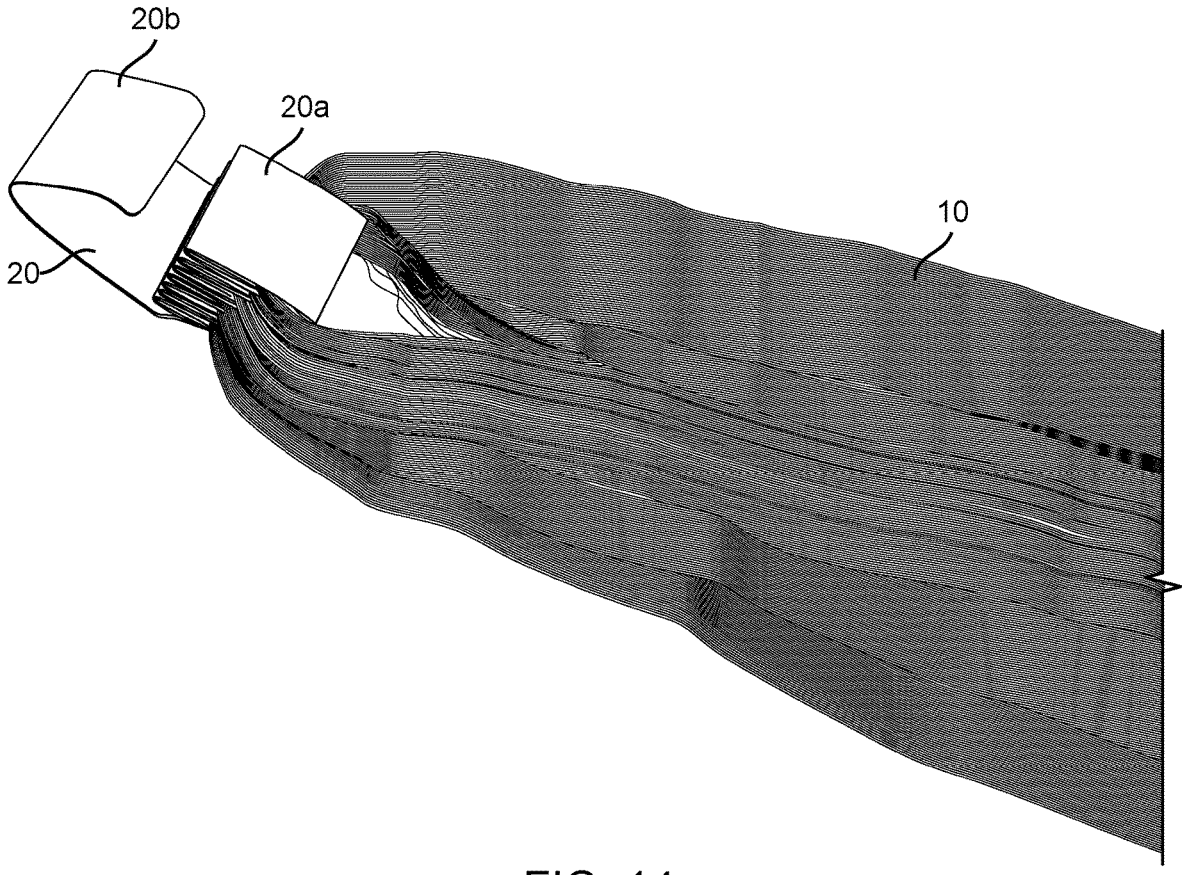
FIG. 14 shows the divider removed from the packaging in a partially open state.
Figure 15:
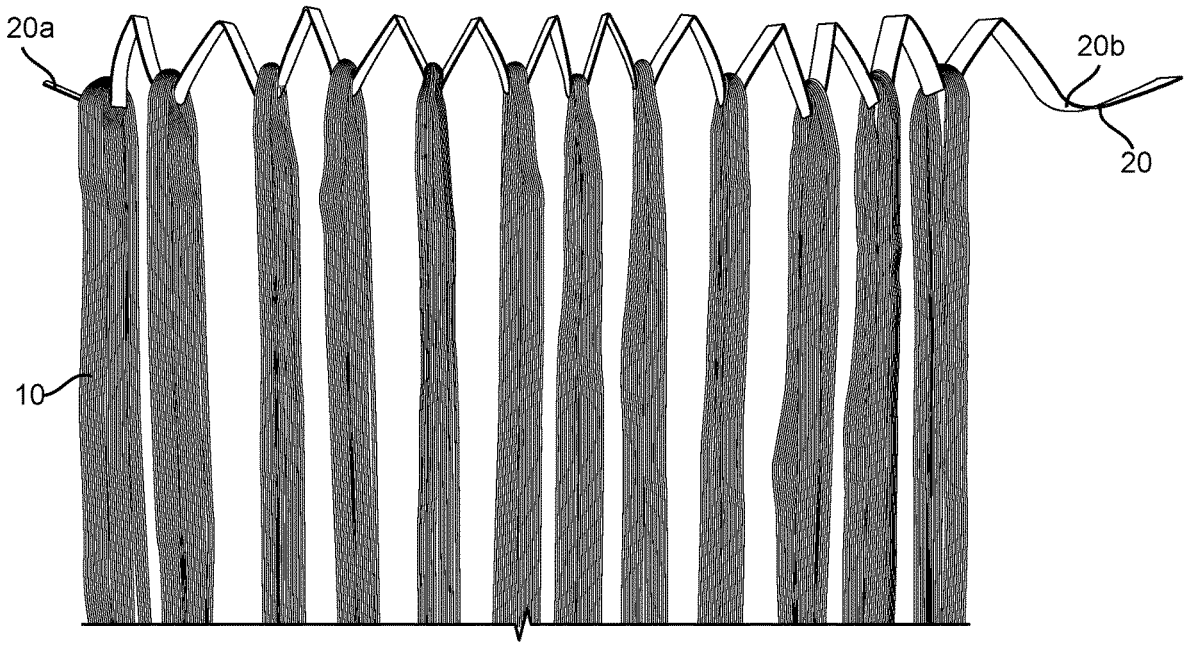
FIG. 15 shows the divider removed from the packaging in an open state.

Referring to FIGS. 14 and 15, with the packaging 1 of the present invention, a stylist removes the bundle sets 30 from the backing member 50 and then disengages the adhesive tape 26 and the second end section 20*b* of the divider 20 from the remaining portions of the divider 20, as shown in FIG. 14. The second end section 20*b* is then unwrapped and the divider 20 is extended from the first end 19*a* to the second end 19*b*, as shown in FIG. 15. The divider 20 is then placed on a surface or hung, with each bundle 10 remaining within a respective retaining member 23. As a result, each bundle 10 is made available for immediate use without having to further prep the hair strands 2.

The present invention eliminates the need for a stylist to separate hair strands from packaged hair extensions prior to use and therefore reduces the total amount of time to prepare and install hair extensions. As such, the end user is likely to save on cost of installation.

The present invention may be embodied in other specific forms without departing from its spirit or essential characteristics. The described embodiments are to be considered in all respects only as illustrative and not restrictive. The scope of the invention will be, therefore, indicated by claims rather than by the foregoing description. All changes, which come within the meaning and range of equivalency of the claims, are to be embraced within their scope.

What is claimed is:

1. A hair product packaging comprising:

a hair product having a plurality of hair strands, each hair strand having a first end and an opposing second end, the plurality of hair strands separated into a plurality of bundles, each bundle having a proximal end and an opposing distal end, the hair strands of each bundle folded such that the first and second ends are substantially aligned with each other at the distal end while a substantial mid-point of the hair strands form a loop at the proximal end, the plurality of bundles forming a set;

a plurality of retaining members, each retaining member of the plurality of retaining members having a pair of retaining walls, each retaining wall of the pair of retaining walls extending downwardly from a free end and coupled together at a lower engagement portion, an open space formed above the lower engagement portion between the retaining walls, the loop of each bundle positioned within a retaining member of the plurality of retaining members on the lower engagement portion below the open space;

a securing member, the securing member configured to secure the plurality of retaining members together; and a backing member, the securing member being fixed to the backing member such that the hair product is positioned on the backing member and displayed.

2. The hair product packaging of claim 1, wherein the backing member comprises at least one aperture.

3. The hair product packaging of claim 2, wherein the securing member is fixed to the backing member with a fastener, the fastener extending through one of the at least one aperture.

4. The hair product packaging of claim 3, wherein the fastener is selected from a group consisting of a twist tie, a rubber band and a clip.

5. The hair product packaging of claim 1, where the securing member is fixed to the backing member with an adhesive.

6. The hair product packaging of claim 1, further comprising a coupling member, the coupling member retaining the plurality of bundles of each set together such that a portion of the plurality of bundles between the proximal and distal ends is completely circumscribed by the coupling member.

7. The hair product packaging of claim 1, further comprising a cover, the cover enclosing the hair product, plurality of retaining members, securing member and backing member collectively.

8. A hair product packaging comprising:

a hair product having a plurality of hair strands, each hair strand having a first end and an opposing second end, the plurality of hair strands separated into a plurality of bundles, each bundle having a proximal end and an opposing distal end, the hair strands of each bundle folded to form a loop between the first and second ends;

a plurality of retaining members, each retaining member of the plurality of retaining members having a pair of retaining walls, each retaining wall of the pair of retaining walls extending downwardly from a free end and coupled together at a lower engagement portion, an open space formed above the lower engagement portion between the retaining walls, the loop of each bundle positioned within a retaining member of the plurality of retaining members on the lower engagement portion below the open space;

a securing member, the securing member configured to secure the plurality of retaining members together; and a backing member, the securing member being fixed to the backing member such that the hair product is positioned on the backing member and displayed.

9. The packaging of claim 8, wherein the first and second ends are substantially aligned with each other at the distal end when folded.

10. The packaging of claim 8, wherein each of the plurality of retaining members are positioned on a divider, the divider having a first end section and an opposing second end section, and a plurality of fold lines therebetween to form an accordion fold, each bundle secured within a fold line.

11. The packaging of claim 10, wherein the securing member is the divider second end section.

12. The hair product packaging of claim 8, wherein the backing member comprises at least one aperture.

13. The hair product packaging of claim 12, wherein the securing member is fixed to the backing member with a fastener, the fastener extending through one of the at least one aperture.

14. The hair product packaging of claim 13, wherein the fastener is selected from a group consisting of a twist tie, a rubber band and a clip.

15. The hair product packaging of claim 8, further comprising a coupling member, the coupling member retaining the plurality of bundles of each set together such that a portion of the plurality of bundles between the proximal and distal ends is completely circumscribed by the coupling member.

16. The hair product packaging of claim 8, further comprising a cover, the cover enclosing the hair product, plurality of retaining members, securing member and backing member collectively.

17. A method for packaging a hair product comprising a plurality of hair strands having a first end and an opposing second end, the method comprising the steps of:

separating the plurality of hair strands into a plurality of bundles;

folding the hair strands of each bundle to form a loop between the first and second ends;

positioning each loop within a retaining member of a plurality of retaining members, each retaining member of the plurality of retaining members having a pair of retaining walls, each retaining wall of the pair of retaining walls extending downwardly from a free end and coupled together at a lower engagement portion, an open space formed above the lower engagement portion between the retaining walls, the loop of each bundle positioned on the lower engagement portion below the open space;

securing the plurality of retaining members together with a securing member; and fixing the securing member to a backing member such that the hair product is positioned on the backing member and displayed.

18. The method of claim 17, wherein each of the plurality of retaining members are positioned on a divider, the divider having a first end section and an opposing second end section, and a plurality of fold lines therebetween to form an accordion fold, each bundle secured within a fold line.

19. The method of claim 18, wherein the securing member is the divider second end section having a divider second end.

20. The method of claim 19, wherein the plurality of retaining members are secured together by looping the divider section second end section around the plurality of retaining members and fixing the divider second end to the divider second end section.

* * * * *